United States Patent [19]

Miller

[11] Patent Number: 4,609,784

[45] Date of Patent: Sep. 2, 1986

[54] LOUDSPEAKER WITH MOTIONAL FEEDBACK

[75] Inventor: William Miller, West Lothian, Great Britain

[73] Assignee: Linn Products Ltd., Glasgow, United Kingdom

[21] Appl. No.: 633,201

[22] Filed: Jul. 23, 1984

[30] Foreign Application Priority Data

Aug. 12, 1983 [GB] United Kingdom ..... 8321810

[51] Int. Cl.[4] ..... H04R 9/00; H04R 3/08; H04R 9/02; H04R 9/06

[52] U.S. Cl. ..... 179/115.5 DV; 179/115.5 R; 179/115.5 VC; 381/96

[58] Field of Search ..... 179/115.5 DV, 115.5 R, 179/115.5 VC; 381/96

[56] References Cited

U.S. PATENT DOCUMENTS

| | | | |
|---|---|---|---|
| 3,798,374 | 3/1974 | Meyers | 381/96 |
| 3,937,905 | 2/1976 | Manger | 179/115.5 DV |
| 4,243,839 | 1/1981 | Takahashi et al. | 381/96 |
| 4,256,923 | 3/1981 | Meyers | 381/96 |
| 4,276,443 | 6/1981 | Meyers | 381/96 |
| 4,295,006 | 10/1981 | Tanaka et al. | 381/99 |
| 4,421,956 | 12/1983 | O'Neill | 179/115.5 R |

FOREIGN PATENT DOCUMENTS

| | | | |
|---|---|---|---|
| 1217136 | 5/1960 | France | 179/115.5 DV |
| 55-90199 | 5/1979 | Japan | 179/115.5 DV |

*Primary Examiner*—Gene Z. Rubinson
*Assistant Examiner*—Danita R. Byrd
*Attorney, Agent, or Firm*—Gerald J. Ferguson, Jr.; Michael P. Hoffman; James E. Bryan

[57] ABSTRACT

A loudspeaker having a main magnet assembly 10,14,16 and voice coil 20 driving a diaphragm 24 via a coupling 22 is provided with a motional feedback transducer comprising twin axially-disposed coils 38,40 mounted on the coupling 22 for movement in a secondary, radial magnetic field produced by magnets 28 and 30.

5 Claims, 1 Drawing Figure

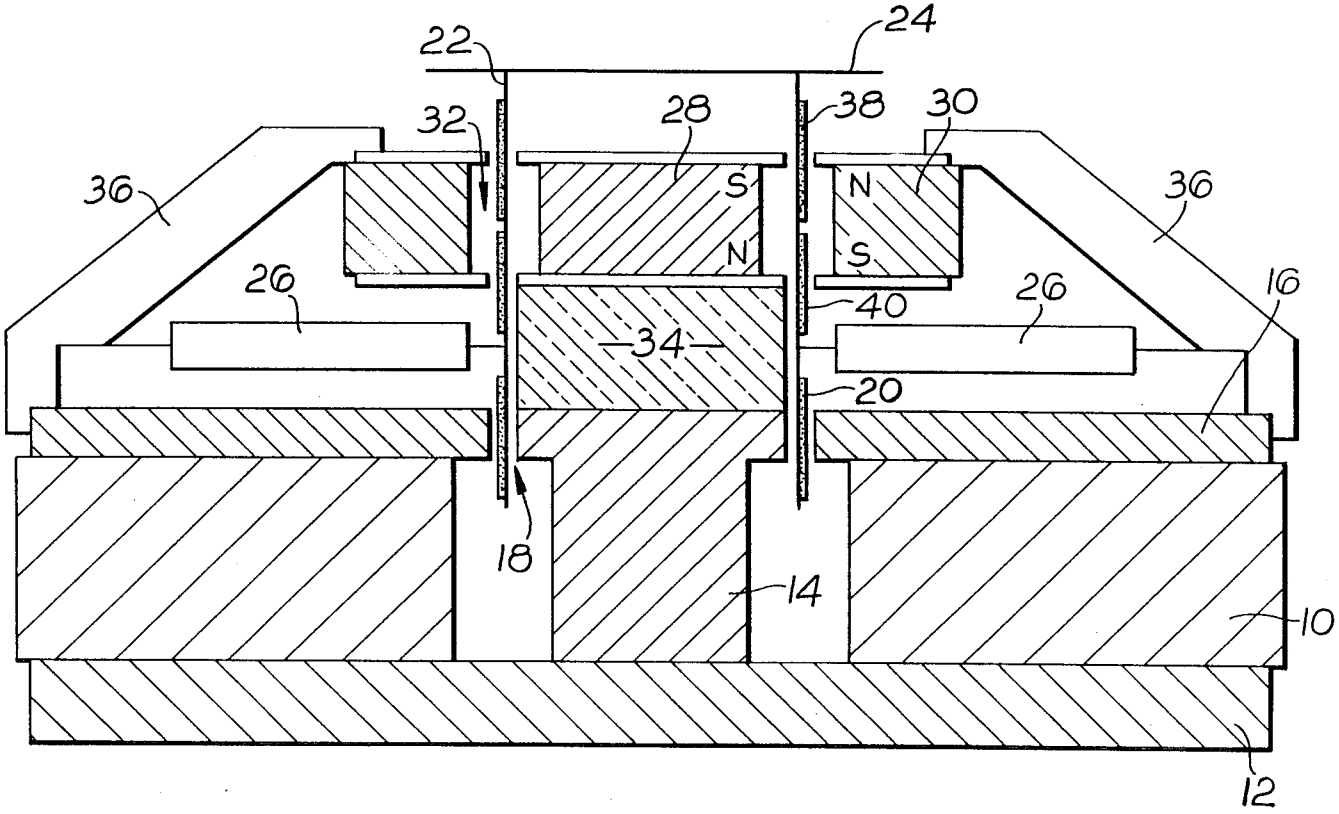
10
12
16
36
26
30
24
38
N
S
40
20
14
S
N
28
34
18
22
32
26
36

LOUDSPEAKER WITH MOTIONAL FEEDBACK

This invention relates to a loudspeaker provided with means for producing a motional feedback signal which is used to modify the driving signal to reduce distortion and increase fidelity.

Arrangements of this type have been used in the past. In one known arrangement, the feedback signal has been produced by a transducer such as a piezoelectric element secured to the cone of an existing loudspeaker. It is difficult to optimise such an arrangement because the cone itself is distorted in different modes with varying amplitudes and frequencies of applied signal.

It is also known, for example from GB-A-1 534 842, to generate a feedback signal by means of a coil driven in unison with the voice coil within a magnetic field. Such arrangements however as heretofore proposed suffer from various disadvantages. In particular they are liable to generate erroneous signals because of the proximity of the feedback transducer to the main magnet and voice coil of the loudspeaker. Attempting to meet this problem by increasing the spacing between these parts and/or using a strong secondary magnet for the feedback transducer leads to a relatively large structure in front of the central portion of the diaphragm which in turn gives a poor high-frequency performance.

The invention is accordingly concerned with a loudspeaker comprising a diaphragm and a drive assembly connected to drive the diaphragm in accordance with an input signal; the drive assembly comprising means for producing a primary magnetic field, a main coil positioned in said primary magnetic field and connected to receive the input signal, mechanical coupling means interconnecting the main coil and the diaphragm; and a transducer mounted in the drive assembly to produce a feedback signal which is a function of the motion of said mechanical coupling means.

The invention obviates or mitigates the above problems by using a transducer which comprises means for establishing a secondary magnetic field and a pair of coils positioned within the secondary magnetic field for electrical connection in anti-phase.

An embodiment of the invention will now be described, by way of example, with reference to the accompanying drawing which shows a diagrammatic cross-sectional side view of a loudspeaker drive assembly.

An annular main magnet 10 is provided with pole pieces 12,14,16 to establish a high flux in an annular gap 18. A main coil 20 is mounted on a tubular support 22 to drive the base 24 of a diaphram (not otherwise shown).

The tubular support 22 is mounted by a suspension 26. All these members are conventional in the art.

In accordance with the invention, the drive assembly includes a motional feedback transducer as will now be described. A secondary magnet assembly is provided in the form of a ferrite disc 28 and ring 30 which are axially poled as shown to establish a substantially radial flux in the annular space 32 between them. The disc 28 is supported from the pole piece 14 via an aluminium slug 34, while the ring 30 is mounted by arms 36. Two coils 38,40 are mounted on the tubular support 22 for movement in the annular space 32 in unison with the main coil 20. The coils 38,40 are electrically connected in anti-phase, thus allowing any interference from the main coil 20, produced by transformer effect, to be cancelled out. The aluminium slug 34 also assists in reducing such interference.

Thus the coils 38,40 produce an output signal which is an accurate function of the motion of the drive assembly, and can be used as a motional feedback signal.

I claim:

1. A loudspeaker comprising a diaphragm and a drive assembly connected to drive the diaphragm in accordance with an input signal; the drive assembly comprising means for producing a primary magnetic field, a main coil positioned in said primary magnetic field and connected to receive the input signal, mechanical coupling means interconnecting the main coil and the diaphragm; and a transducer mounted in the drive assembly to produce a feedback signal which is a function of the motion of said mechanical coupling means, said transducer comprising means for establishing a secondary magnetic field and a pair of coils positioned within the secondary magnetic field for electrical connection in anti-phase.

2. The loudspeaker of claim 1, in which the transducer coils are mounted on the mechanical coupling means for movement in the secondary magnetic field.

3. The loudspeaker of claim 2, in which said mechanical coupling means has an axis perpendicular to said diaphragm, and the transducer coils are axially spaced along the coupling means.

4. The loudspeaker of claim 2, in which the secondary magnetic field is produced by a ferrite disc surrounded by a ferrite ring to define an annular gap therebetween, the disc and ring being poled to produce a substantially radial magnetic field in said gap.

5. The loudspeaker of claim 4, in which the ferrite disc is mounted on a central pole piece of the primary magnet assembly via a block of conductive material.

* * * * *